US007350583B2

(12) United States Patent
Nguyen et al.

(10) Patent No.: US 7,350,583 B2
(45) Date of Patent: Apr. 1, 2008

(54) ONE TRIP STRING TENSIONING AND HANGER SECURING METHOD

(75) Inventors: Dennis P. Nguyen, Houston, TX (US); Delbert Vanderford, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 227 days.

(21) Appl. No.: 10/614,286

(22) Filed: Jul. 7, 2003

(65) Prior Publication Data

US 2005/0006107 A1 Jan. 13, 2005

(51) Int. Cl.
*E21B 23/01* (2006.01)

(52) U.S. Cl. ..... 166/379; 166/382; 166/387; 166/348

(58) Field of Classification Search ..... 166/382, 166/348, 360, 368, 379, 378, 387
See application file for complete search history.

(56) References Cited

U.S. PATENT DOCUMENTS 4,791,986 A * 12/1988 Vallet ..... 166/379
4,903,776 A * 2/1990 Nobileau et al. ..... 166/382
5,002,131 A 3/1991 Cromar et al.
5,255,746 A 10/1993 Bridges
5,310,007 A 5/1994 Parikh
5,439,061 A * 8/1995 Brammer et al. ..... 166/368
5,839,512 A 11/1998 Malone et al.
6,142,233 A * 11/2000 Wilkins ..... 166/360
6,516,887 B2 * 2/2003 Nguyen et al. ..... 166/348
7,025,145 B2 * 4/2006 Emmerson ..... 166/348

* cited by examiner

*Primary Examiner*—Lanna Mai
*Assistant Examiner*—Matthew J. Smith
(74) *Attorney, Agent, or Firm*—Peter Bielinski; Manish Vyas; Fletcher Yoder

(57) ABSTRACT

A running tool delivers a string through a wellhead in the same trip as a hanger with a seal and locking assembly. The string is secured downhole and the running tool is manipulated to release a lock to hold the hanger in a sealed position in the wellhead prior to a tensile force being applied. A ratchet assembly permits the string to stretch and the tensile force is then locked in. The running tool is rotated out of the string and the tree is installed on the wellhead for subsequent procedures or production.

22 Claims, 11 Drawing Sheets

ONE TRIP STRING TENSIONING AND HANGER SECURING METHOD

FIELD OF THE INVENTION

The field of this invention relates to methods for running in and tensioning a tubular string to a wellhead and more particularly where the hanger is sealed and secured in a single trip when tensioning.

BACKGROUND OF THE INVENTION

In an oil and gas well, one or more strings of casing will be cemented within the well. In one system used with offshore jack-up drilling rigs, a mudline hanger located in a subsea housing at the sea floor will support the string of casing in the well. A section of the casing will extend upward to a surface wellhead housing on the drill rig. The surface wellhead housing will be located above the sea and below the rig floor. The distance from the subsea housing to the surface wellhead could be as much as 500 feet with a large jack-up drilling rig.

Cement will be pumped down the string to flow up the annulus to cement the casing in the well. The level of cement will be below the mudline hanger. The casing will be cut off at the surface wellhead. The blowout preventer will be removed, and a spear will be used to pull tension on the casing after cementing. Then slips will be inserted around the casing, which engage the wellhead housing and grip the casing to hold the casing in tension. A packoff will be installed between the casing hanger and the wellhead housing.

A disadvantage of this system is that the blowout preventer must be removed while installing the slips and packoff. A danger of a blowout thus exists. Also, this system is time consuming and expensive. In addition to this, the sealing mechanisms are generally elastomer or on site machined to give metal-to-metal seals.

In another design, described in U.S. Pat. No. 5,002,131 after cementing, dogs mounted to the exterior of the casing hanger are released. Each of the dogs has a set of circumferential grooves or wickers on the exterior for engaging the wellhead housing. The wellhead housing has a mating set of grooves or wickers. Springs urge the dogs outward.

The running tool for the casing hanger has a sleeve retainer. This retainer holds the dogs in the retracted position during cementing. After cementing, rotating the running tool unscrews the running tool from the casing hanger. When this occurs, the sleeve moves upward, releasing the dogs to engage the wellhead housing.

Before the running tool completely releases, tension is applied to the casing to the desired amount. The dogs ratchet over the wickers in the wellhead housing as the casing hanger moves up while the tension is applied. The dogs grip the wellhead housing, preventing the casing hanger from moving downward. The running tool and sleeve are then removed from the wellhead housing. Thereafter, in a separate trip, a seal assembly is installed to seal the annular gap between the string and the wellhead. A similar design is disclosed in U.S. Pat. No. 5,255,746. String tensioning devices are generally illustrated in U.S. Pat. Nos. 5,310,007 and 5,839,512.

The present invention seeks to overcome some of the shortcomings of the prior designs. It provides a one-trip method to apply tension to the string and to seal the hanger in the annular space. It also has capability to lock the hanger in a sealed position in the same single trip. It accordingly minimizes the time the annular space is open and improves the safety of the operation by providing the isolation capability in that same single trip. These and other advantages of the present invention will become more apparent to those skilled in the art from a review of the description of the preferred embodiment and the claims that appear below.

SUMMARY OF THE INVENTION

A running tool delivers a string through a wellhead in the same trip as a hanger with a seal and locking assembly. The string is secured downhole and the running tool is manipulated to release a lock to hold the hanger in a sealed position in the wellhead prior to a tensile force being applied. A ratchet assembly permits the string to stretch and the tensile force is then locked in. The running tool is rotated out of the string and the tree is installed on the wellhead for subsequent procedures or production.

DETAILED DESCRIPTION OF THE PREFERRED EMBODIMENT

Figure 1:
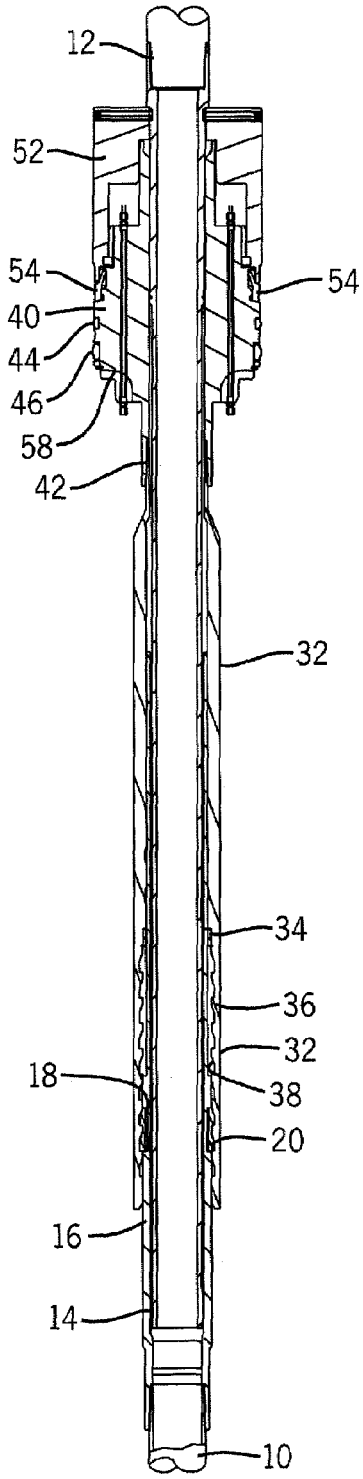
FIG. 1 is a section view, in elevation, of one embodiment of the running tool shown supporting a string to be inserted into a wellhead.
Figure 2:
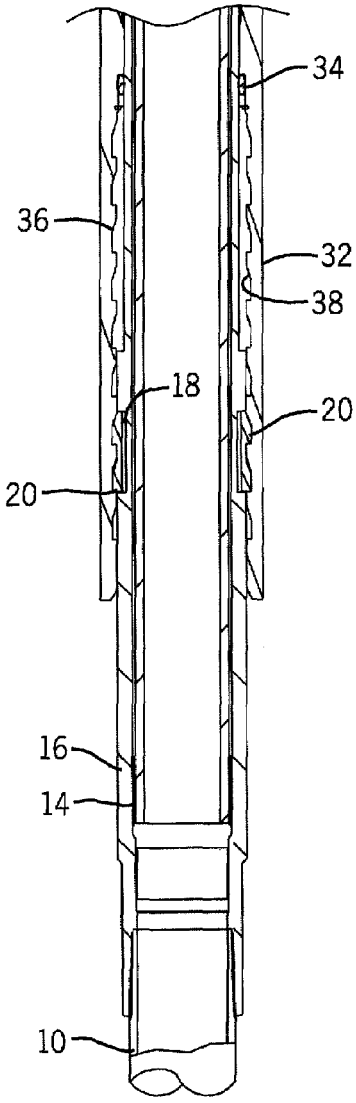
FIG. 2 is an enlargement of the lower end of FIG. 1 showing the ratchet assembly in more detail.
Figure 3A:
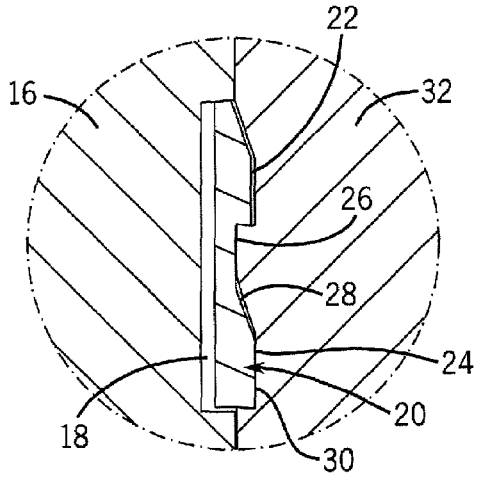
FIGS. 3A and 3B show alternative designs for the locking dog in the ratchet assembly.
Figure 3B:
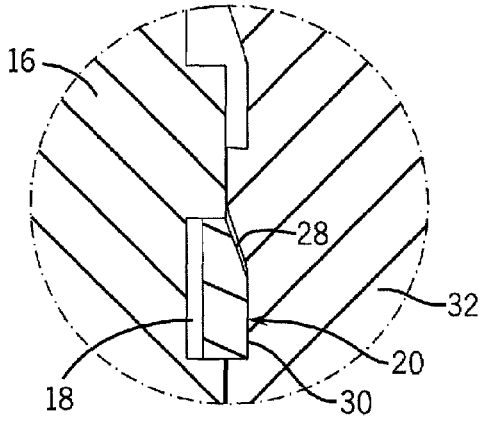

Referring to FIGS. 1 and 2, a string 10 is supported by a running tool 12 at thread 14. String 10 is also secured to inner ratchet sleeve 16, which has a groove 18 in which is disposed a dog 20. Two different embodiments of dog 20 are shown in FIGS. 3A and 3B. In FIG. 3A, dog 20 has two peak surfaces 22 and 24 separated by a valley surface 26. In the FIG. 3B embodiment, the dog 20 has a single sloping surface 28 adjacent a cylindrical surface 30. Outer ratchet sleeve 32 surrounds inner ratchet sleeve 16 and seal 34 seals between them. Those skilled in the art will appreciate that seal 34 can be mounted on the inner sleeve 16 or the outer sleeve 32. Similarly, the ratchet assembly now being described can be reversed as between these two sleeves without departing from the scope of the invention. In the preferred embodiment, outer sleeve 32 has a ratchet rack 36 defining a plurality of depressions 38 that conform in shape to peak surfaces 22 and 24 shown in FIG. 3A or surfaces 28 and 30 shown in FIG. 3B. Preferably, dog 20 is a split ring having a c-shape with a built in outward bias out of groove 18. Those skilled in the art will appreciate that other forms of bias can be applied to dog 20 external to its structure and still be within the scope of the invention. As shown in FIGS. 1 and 2 inner sleeve 16 can move up with respect to outer sleeve 32 and dog 20 will simply jump from one depression 38 to another as its diameter decreases to allow such movement. Relative movement in the reverse direction will be precluded by dog 20 expanding into the most adjacent depression 38 and locking the sleeves 16 and 32 to each other.

Figure 4:
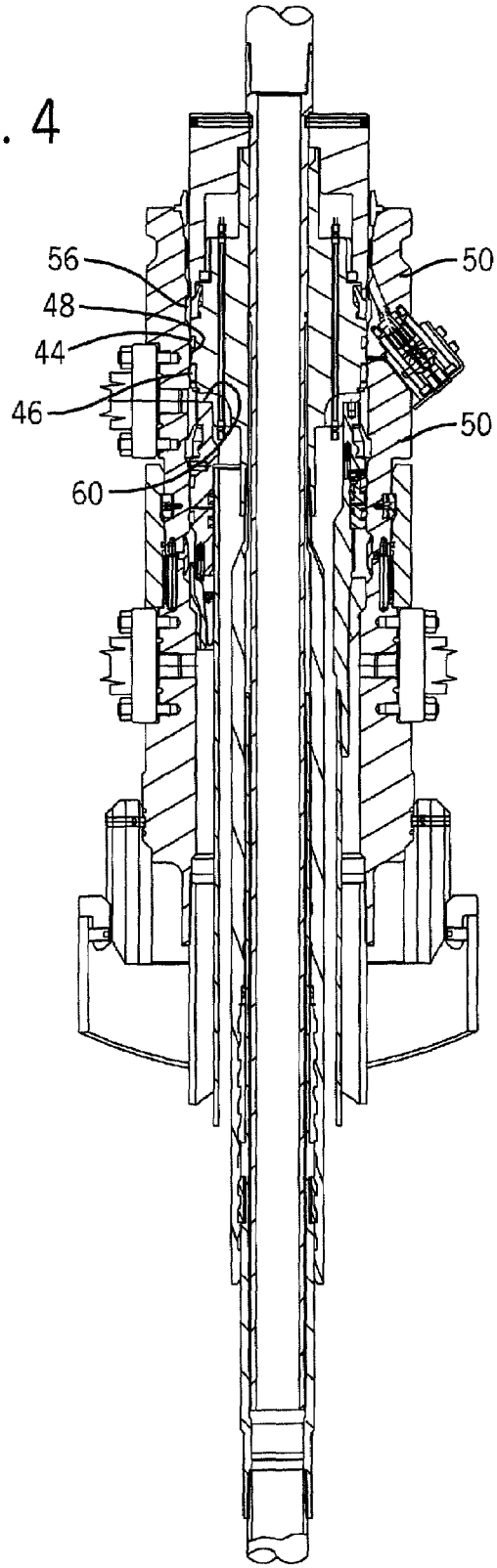
FIG. 4 is the assembly of FIG. 1 landed in a wellhead.

Referring again to FIG. 1, outer sleeve is connected to hanger 40 at thread 42. Seals 44 and 46 are supported on hanger 40 for sealing contact with surface 48 of wellhead 50, as shown in FIG. 4. Referring back to FIG. 1, a lock retainer sleeve 52 holds in a locking ring 54 when running the string 10 into the wellhead 50. Rotation of running tool 12 backs out thread 14 and allows sleeve 52 to rise away from locking ring 54. When this happens, locking ring 54 can snap out into a groove 56 in wellhead 50 (see FIG. 4).

The method proceeds as follows. The running tool 12 supports the string 10 as well as the hanger 40 and the sleeve 52 in a position where it is retaining the locking ring 54 in a retracted position. Initially, the string 10 is tagged downhole to a seal bore or packer (not shown). In any event, the lower end of string 10 is secured downhole. A shoulder 58 on hanger 40 (see FIG. 1) is landed on a shoulder 60 in wellhead 50. This is the position in FIG. 4.

Figure 5:
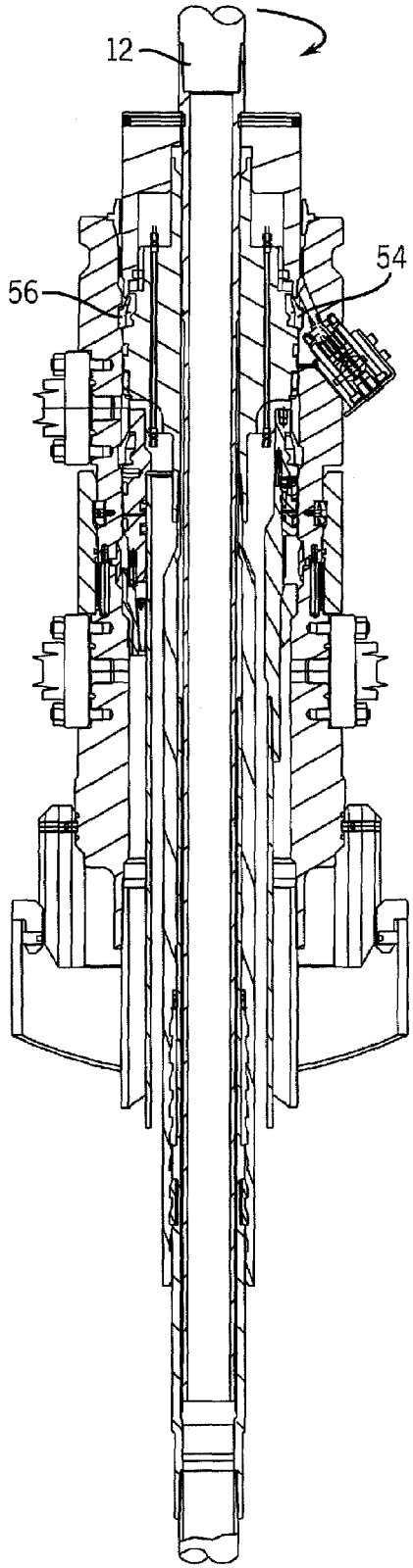
FIG. 5 is the view of FIG. 4 after the hanger is locked and sealed in the wellhead.

In FIG. 5, the running tool 12 is rotated to back out thread 14 and raise sleeve 52 away from locking ring 54 to allow it to snap out into groove 56. The hanger 40 is thus locked to the wellhead 50 and seals 44 and 46 seal between the two.

Figure 6:
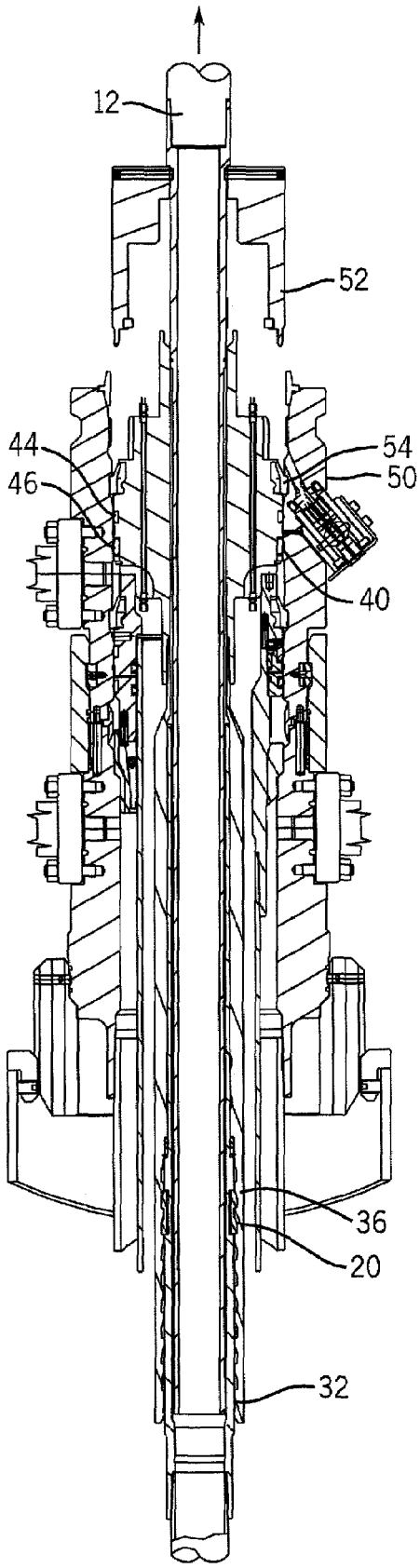
FIG. 6 is the view of FIG. 5 showing tension being pulled on the running tool.

In FIG. 6, thread 14 is still engaged so that an upward pull on the running tool 12 puts tension on string 10 while inner sleeve 16 moves up with string 10 as the tension is being applied. Dog 20 skips along ratchet rack 36. Outer sleeve 32 is stationary at this time because the hanger 40 is secured to wellhead 50 by locking ring 54 and outer sleeve 32 is secured to hanger 40 at thread 42. After the appropriate tension is pulled on the running tool 12 the pulling force is removed. Groove 18 with dog 20 move down until dog 20 can spring out into a depression 38. At that point the one trip procedure is concluded. The necessary tension is on the string 10 and hanger 40 is locked to wellhead 50 by lock ring 54. Seals 44 and 46 also seal the hanger 40 to wellhead 50. Those skilled in the art will appreciate that one or more seals can be used and they can be mounted in the wellhead 50 instead of or in addition to the hanger 40.

Figure 7:
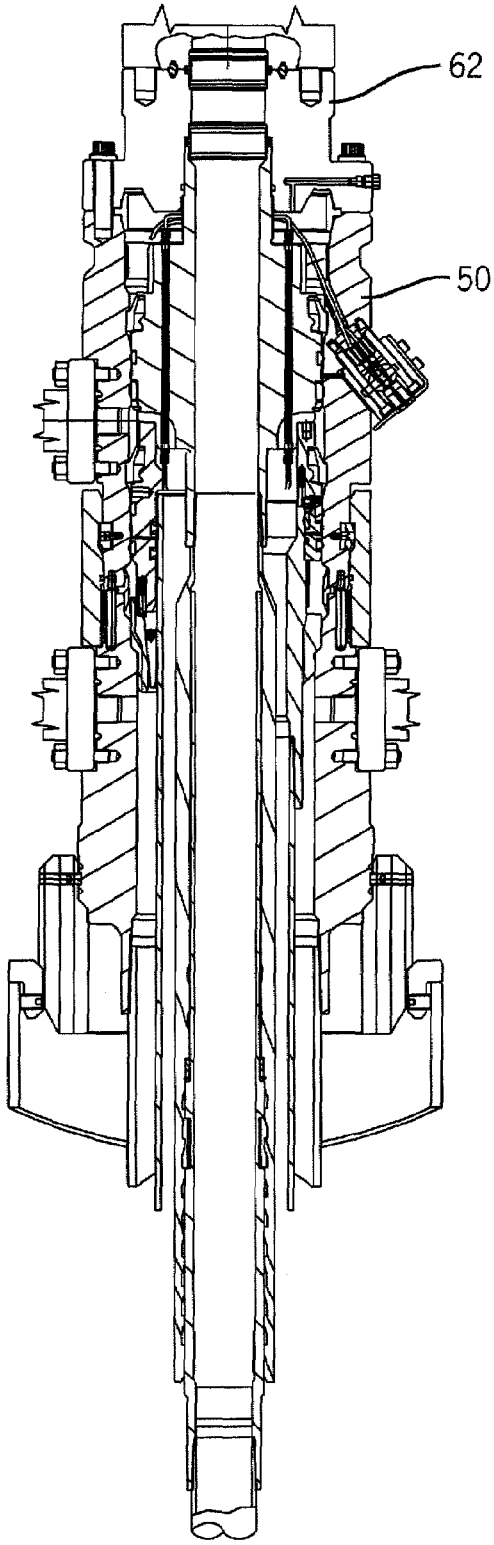
FIG. 7 is the view of FIG. 6 with the running tool removed and a tubing head adaptor installed.

FIG. 7 shows the running tool 12 released at thread 14 and pulled out of the well. In its place a tubing head adapter 62 is installed. Alternatively other equipment could be installed depending on the nature of the string 10 being run into the well.

Figure 8:
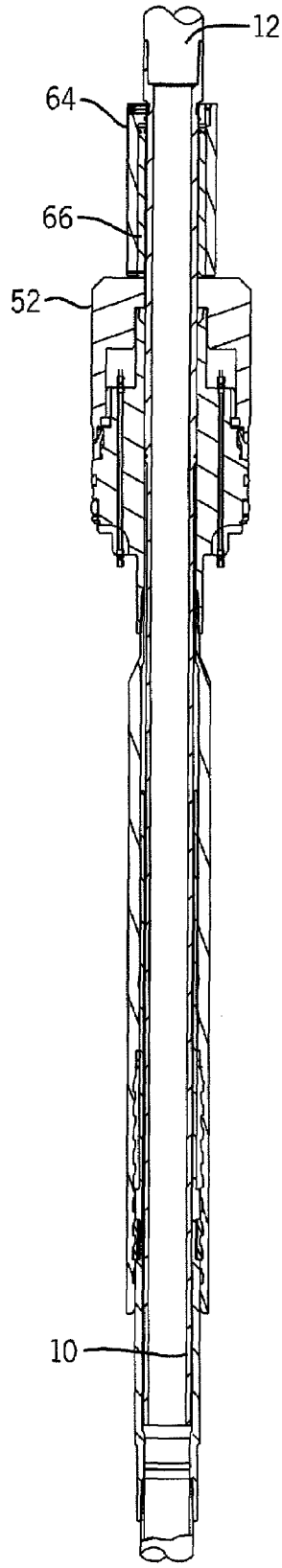
FIG. 8 is an alternative design to FIG. 1 featuring a hydraulic piston on the running tool.
Figure 9:
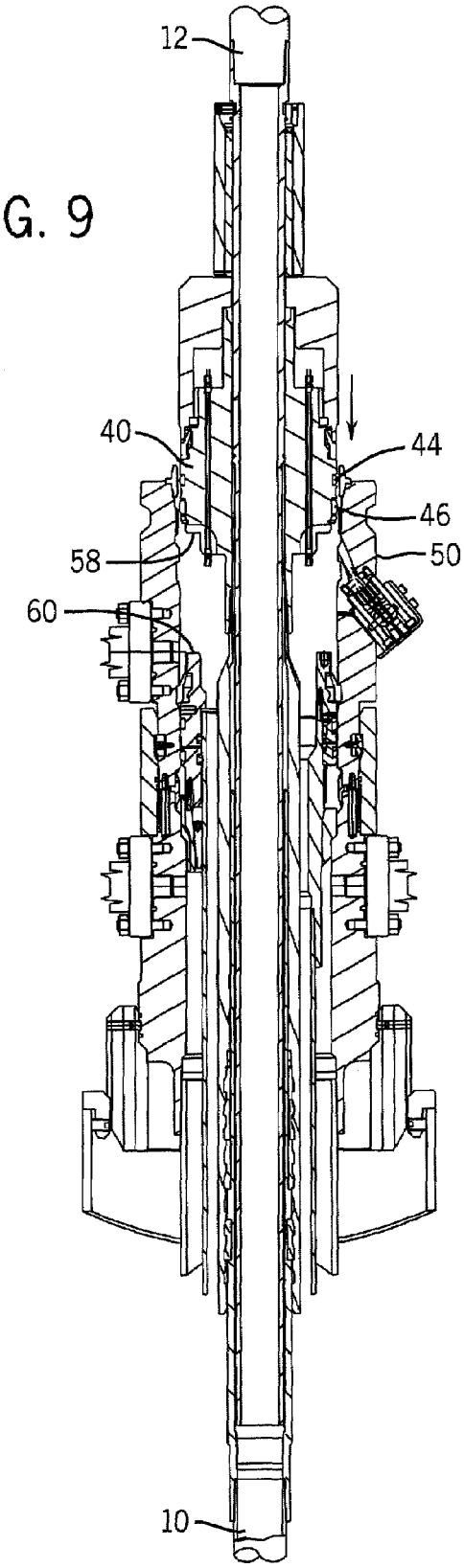
FIG. 9 is the view of FIG. 8 with the tubing tied back at its lower end in the wellbore.

FIG. 8 is an alternative embodiment to FIG. 1 and is identical except that it features a hydraulic cylinder 64 mounted to the running tool 12 with the capability of stroking a piston 66 to selectively slide sleeve 52 along the running tool 12 for reasons that will be explained below. Mechanical equivalents such as a rack and pinion are also contemplated.

As before, the string 10 is shown inserted into the wellhead 50 to allow the operation of a downhole tool or to secure the lower end of the string 10 to a seal bore or some other anchor (not shown). Securing the lower end of the string 10 allows for tension to be pulled on it.

Figure 10:
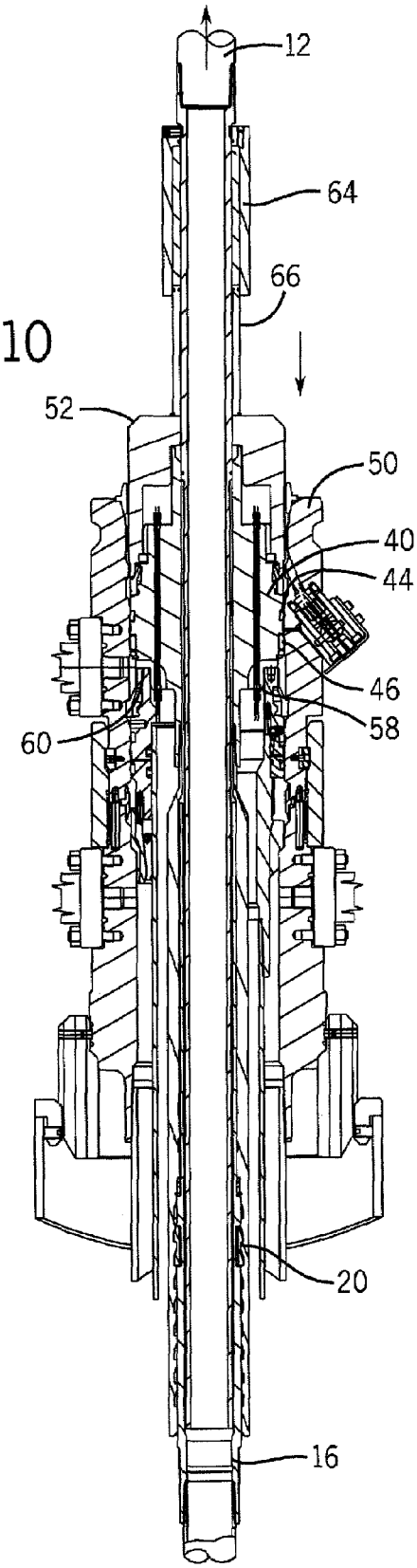
FIG. 10 is the view of FIG. 9 showing tension on the string and operation of the hydraulic piston to land the hanger in the wellhead.

FIG. 10 shows the tension applied to the running tool 12, which extends the string 10 and moves up inner sleeve 16 and dog 20 along with ratchet rack 36. With the tension applied to running tool 12, piston 66 is stroked to move down hanger 40 until its contact surface 58 engages shoulder 60 in wellhead 50. Piston 66 can be stroked as the tension is being applied or before or after. Seals 44 and 46 are now in sealing engagement in the wellhead 50.

Figure 11:
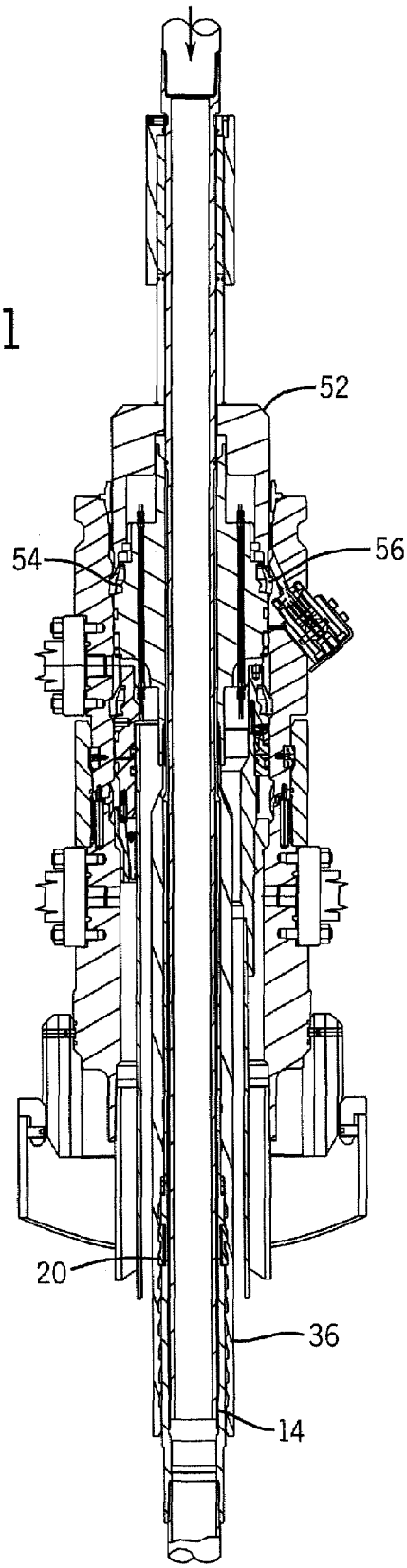
FIG. 11 is the view of FIG. 10 with the tensile force removed and the tension locked in with the ratchet and the hydraulic piston actuating the hanger into final position where it will be locked in after rotation of the running tool.
Figure 12:
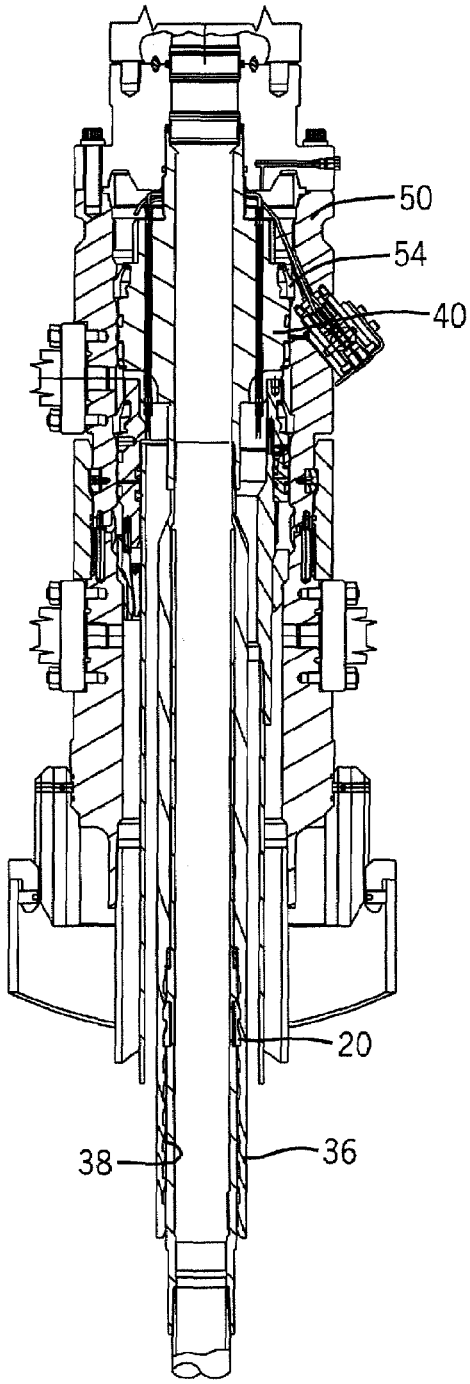
FIG. 12 is the view of FIG. 11 with the running tool removed and a tubing head adaptor installed.

FIG. 11 shows the tension removed to allow dog 20 to engage ratchet rack 36 as previously described to hold in the applied tension. The running tool 12 is rotated to allow sleeve 52 to move away from locking ring 54 so it can spring out into groove 56 in wellhead 50. The running tool can be removed after thread 14 is fully undone.

Thereafter, a tubing head adapter 62 or some other device depending on the nature of the string 10 is fitted to the wellhead 50.

In either embodiment, the result is that in a single trip a tensile force is applied to the string 10 and the hanger 40 is placed in a sealing relationship to the wellhead 50 using seals 44 and 46. In the same trip the hanger is locked in position with locking ring 54 or an equivalent structure. In the preferred embodiment of FIGS. 1-7 the act of sealing the hanger 40 is independent of locking it to wellhead 50. These two operations can also be combined or one made dependent on the other. A separate trip to install a seal or locking device is eliminated.

The above description of the preferred embodiment is merely illustrative of the optimal way of practicing the invention and various modifications in form, size, material or placement of the components can be made within the scope of the invention defined by the claims below.

We claim:

1. A one trip method of tensioning and sealing a tubular string to a wellhead, comprising:
- running the tubular string and a seal assembly together into the wellhead;
- securing the string downhole;
- securing the seal assembly in the wellhead; and
- applying and retaining a tensile force on the string after securing the seal assembly to the wellhead and after securing the string downhole.

2. The method of claim 1, comprising:
- securing said seal assembly to a hanger; and
- securing the hanger and seal assembly to the wellhead.

3. A one trip method of tensioning and sealing a tubular string to a wellhead, comprising:
- running the tubular string and a seal assembly together into the wellhead;
- securing the string downhole;
- positioning the seal assembly in contact with the wellhead;
- pulling a tensile force on the string; and
- allowing a lock ring to move between said seal assembly and the wellhead to secure said seal assembly in the wellhead prior to said pulling, all in one trip.

4. A one trip method of tensioning and sealing a tubular string to a wellhead, comprising:
- running the tubular string and a seal assembly together into the wellhead;
- securing the string downhole;
- positioning the seal assembly in contact with the wellhead;
- pulling a tensile force on the string;
- allowing a lock ring to move between said seal assembly and the wellhead to secure said seal assembly in the wellhead;
- using a running tool to deliver said string and seal assembly; and
- releasing said lock ring using said running tool, all in one trip.

5. The method of claim 4, comprising:
retaining said string with the running tool after releasing said lock ring.

6. The method of claim 5, comprising:
releasing the lock ring by rotation of the running tool.

7. The method of claim 4, comprising:
using the running tool to pull tension on said string;
locking in the tension with a ratchet.

8. The method of claim 7, comprising:
providing a biased dog in a groove on said string having at least one exterior tooth;
securing a ratchet rack to said seal assembly;
moving said dog with respect to said rack while tension is applied; and
allowing said dog to retain said tension when said tooth jumps into an adjacent depression in said rack.

9. The method of claim 8, comprising:
building in said bias integrally into said dog.

10. The method of claim 8, comprising:
providing a seal between said string and said rack during relative movement between them.

11. A one trip method of tensioning and sealing a tubular string to a wellhead, comprising:
running the tubular string and a seal assembly together into the wellhead;
securing the string downhole;
pulling a tensile force on the string;
pulling said tensile force on said string before positioning said seal assembly in the wellhead; and
advancing said seal assembly relative to said string and into said wellhead after said pulling of said tensile force.

12. The method of claim 11, comprising:
using a running tool to insert said string and said seal assembly into the wellhead:
advancing said seal assembly by moving it into the wellhead with respect to said running tool.

13. The method of claim 11, comprising:
securing said seal assembly to a hanger; and
securing the hanger and seal assembly to the wellhead.

14. A one trip method of tensioning and sealing a tubular string to a wellhead, comprising:
running the tubular string and a seal assembly together into the wellhead;
securing the string downhole;
pulling a tensile force on the string;
pulling said tensile force on said string before positioning said seal assembly in the wellhead;
advancing said seal assembly into said wellhead during or after said pulling of said tensile force; and
using a mechanical force applied to said seal assembly for said advancing, all in one trip, wherein the mechanical force is independent of the tensile force.

15. A one trip method of tensioning and sealing a tubular string to a wellhead, comprising:
running the tubular string and a seal assembly together into the wellhead;
securing the string downhole;
pulling a tensile force on the string;
pulling said tensile force on said string before positioning said seal assembly in the wellhead;
advancing said seal assembly into said wellhead during or after said pulling of said tensile force;
using a running tool to insert said string and said seal assembly into the wellhead:
advancing said seal assembly by moving it into the wellhead with respect to said running tool; and
releasing a lock, after said advancing, to secure said seal assembly to the wellhead with said running tool, all in one trip.

16. The method of claim 15, comprising:
securing said seal assembly to a hanger; and
securing the hanger and seal assembly to the wellhead.

17. The method of claim 16, comprising:
providing a biased dog in a groove on said string having at least one exterior tooth;
securing a ratchet rack to said hanger;
moving said dog with respect to said rack while tension is applied; and
allowing said dog to retain said tension when said tooth jumps into an adjacent depression in said rack.

18. The method of claim 17, comprising:
providing a seal between said string and said rack during relative movement between them.

19. A one trip method of tensioning and sealing a tubular string to a wellhead, comprising:
running the tubular string and a seal assembly together into the wellhead;
securing the string downhole;
pulling a tensile force on the string;
pulling said tensile force on said string before positioning said seal assembly in the wellhead;
advancing said seal assembly into said wellhead after said pulling of said tensile force; and
using a hydraulic piston to advance said seal assembly, all in one trip, wherein said pulling is a different motion from said advancing.

20. A method of tensioning and sealing a tubular string to a wellhead, comprising:
advancing a tubing string and a seal assembly into the wellhead concurrently;
moving the seal assembly into a secured position with respect to the wellhead; and
applying tension to the tubing string after the seal assembly is in the secured position with respect to the wellhead, wherein moving is different than applying tension.

21. A method for tensioning and sealing a tubular string to a wellhead, comprising:
running a tubular string and a seal assembly together into a wellhead;
securing the string downhole;
applying a mechanical force to the seal assembly to advance the seal assembly into the wellhead; and
applying a tensile force to the string to advance the string in the seal assembly, all in one trip, wherein the tensile force and the mechanical force are applied in different directions.

22. A system for tensioning and sealing a tubular string to a wellhead, comprising:
a seal assembly comprising a lock ring configured to secure the seal assembly to a wellhead and a ratchet configured to secure a tubular string to the seal assembly in a tensile state, all in one trip;
a running tool configured to run the string and the seal assembly together into the wellhead; and
at least one of a seal bore or packer configured to secure the string downhole.

* * * * *